US006727798B2

(12) United States Patent
Akhtman et al.

(10) Patent No.: US 6,727,798 B2
(45) Date of Patent: Apr. 27, 2004

(54) FLIP CHIP RESISTOR AND ITS MANUFACTURING METHOD

(75) Inventors: Leonid Akhtman, Shani (IL); Sakaev Matvey, Arad (IL)

(73) Assignee: Vishay Intertechnology, Inc., Malvern, PA (US)

( * ) Notice: Subject to any disclaimer, the term of this patent is extended or adjusted under 35 U.S.C. 154(b) by 0 days.

(21) Appl. No.: 10/233,184

(22) Filed: Sep. 3, 2002

(65) Prior Publication Data

US 2004/0041688 A1 Mar. 4, 2004

(51) Int. Cl.[7] ..... H01C 1/012

(52) U.S. Cl. ..... 338/309; 338/313; 338/328; 338/332; 338/314

(58) Field of Search ..... 338/309, 313, 338/314, 327, 232

(56) References Cited

U.S. PATENT DOCUMENTS

| | | | | | |
|---|---|---|---|---|---|
| 4,684,916 | A | * | 8/1987 | Ozawa | 338/308 |
| 5,111,179 | A | * | 5/1992 | Flassayer et al. | 338/313 |
| 5,379,017 | A | * | 1/1995 | Katsuno | 338/309 |
| 5,815,065 | A | * | 9/1998 | Hanamura | 338/309 |
| 6,023,217 | A | | 2/2000 | Yamada et al. | |
| 6,150,920 | A | * | 11/2000 | Hashimoto et al. | 338/309 |
| 6,153,256 | A | * | 11/2000 | Kambara et al. | 427/103 |
| 6,238,992 | B1 | | 5/2001 | Yamada | |
| 6,242,999 | B1 | * | 6/2001 | Nakayama et al. | 338/309 |
| 6,304,167 | B1 | * | 10/2001 | Nakayama | 338/195 |
| 6,356,184 | B1 | * | 3/2002 | Doi et al. | 338/309 |
| 6,492,896 | B2 | * | 12/2002 | Yoneda | 338/309 |
| 2002/0130761 | A1 | * | 9/2002 | Tsukada | |

FOREIGN PATENT DOCUMENTS

| | | |
|---|---|---|
| EP | 0810614 | 12/1997 |
| EP | 0 810 614 A1 | 12/1997 |

OTHER PUBLICATIONS

Panasonic, "Fillet Less Thick Film Chip Resistors 0402", (no date).

Vishay Dale, Thick Film Chip Resistors, Military/Established Reliability MIL–PRF–55342/2/3/4/5/6/7/8/9/10 Qualified, Type RM (no date).

Amitron, "Chip Resistors", 1998, p. 1.

* cited by examiner

*Primary Examiner*—Karl D. Easthom
(74) *Attorney, Agent, or Firm*—McKee, Voorhees & Sease, P.L.C.

(57) ABSTRACT

The present invention provides for a flip chip resistor having a substrate having opposite ends, a pair of electrodes formed from a first electrode layer disposed on the opposite ends of the substrate, a resistance layer electrically connecting the pair of electrodes, a protective layer overlaying the resistance layer, and a second electrode layer overlaying the first electrode layer and at least a portion of the protective layer. The present invention provides for higher reliability performance and enlarging the potential soldering area despite small chip size.

A method of the present invention provides for manufacturing flip chip resistors by applying a first electrode layer to a substrate to create at least one pair of opposite electrodes, applying a resistance layer between each pair of opposite electrodes; applying a first protective layer at least partially overlaying the resistance layer, applying a second protective layer at least partially overlaying at least a portion of the resistance layer, and applying a second electrode layer overlaying the first electrode layer and at least a portion of the second protective layer.

5 Claims, 2 Drawing Sheets

FLIP CHIP RESISTOR AND ITS MANUFACTURING METHOD

BACKGROUND OF THE INVENTION

Conventional surface mount resistors have wrap-around terminals on the ends of the resistor. When such surface mount resistors are soldered to a printed circuit board, solder covers entire surface of the terminals forming a fillets, resulting in occupation of an additional area for mounting. One example of such a conventional surface mount resistor is found in EPO 0810614A1 to Hashimoto et al. A flip chip resistor is a resistor that has no side electrodes and is soldered with its printed side towards the printed circuit board. With this configuration, the solder fillets are not formed thus decreasing the amount of circuit board space required and increasing the mounting density particularly in the case of small chip sizes.

Two examples of prior art flip chip resistors are shown in FIGS. 1 and 2. The flip chip resistor shown in FIG. 1 is described in U.S. Pat. No. 6,023,217 to Yamada et al. The flip chip resistor of FIG. 1 improves the quality of mounting and insulation between the printed layers of the resistor and a printed circuit board which is important when there is a printed circuit board trace running between the terminations.

A second prior art attempt at a flip chip resistor is shown in FIG. 2. The device shown in FIG. 2 has been offered by a number of chip manufacturers.

Both of these prior art flip chip resistors have problems. In particular, the area of conductive layers disposed under the joint of a protective overcoat layer and plated Nickel barrier disposed over a Silver electrode is subjected to destructive influence of environmental conditions more than other inner parts of the flip chip resistor because this joint is usually not sufficiently hermetic. This results in reduced reliability, especially in cases of face down mounting when residual flux cannot be reliably removed from the overcoat surface. Therefore, these flip chip resistors require expensive conductive materials based on noble metals (i.e. Pd, Au, Pt) for the top conductive layers in order to prevent erosion of the conductive layers.

A further problem with these configurations is that the pads provided are too small for reliable soldering. This problem becomes even more important in the case of small chip sizes. The pad areas in these prior art designs can only be enlarged when the resistance layer size is changed. Such a change interferes with requirements for laser trimming. Therefore, problems in the art remain.

Thus, it is a primary object of the present invention to improve upon the state of the art.

Another object of the present invention is to provide a flip chip resistor with high reliability.

Yet another object of the present invention is to provide a flip chip resistor that can be manufactured at a low cost.

As a further object of the present invention to provide a flip chip resistor that can be manufactured in small chip sizes.

A further object of the present invention is to provide a flip chip resistor that allows for sufficiently large pads for reliable soldering even when the flip chip resistor is of small size.

These and other objects, features and advantages of the present invention will become apparent from the description and claims that follow.

SUMMARY OF THE INVENTION

The present invention relates to a flip chip resistor.

According to one aspect of the invention, the flip chip resistor includes a substrate having opposite ends, a pair of electrodes, formed from a first electrode layer disposed on the opposite ends of the substrate, a resistance layer electrically connecting the pair of electrodes, a protective layer overlaying the resistance layer, and a second electrode layer overlaying the first electrode layer and at least a portion of the protective layer and optionally a portion of the resistance layer. A plating layer can then be overlayed on the second electrode layer to provide for solder attachment to a printed circuit board. This allows the flip chip resistor to be surface mounted with the resistance layer positioned towards the printed circuit board and results in high reliability.

According to another aspect of the present invention, a method of manufacturing flip chip resistors is provided. The method includes applying a first electrode layer to a substrate to create pairs of opposite electrodes, applying a resistance layer between each pair of opposite electrodes, applying a first protective layer at least partially overlaying the resistance layer, applying a second protective layer at least partially overlaying at least a portion of the resistance layer, and applying a second electrode layer overlaying the first electrode layer and at least a portion of the second protective layer. The substrate can then be divided to form individual flip chip resistors.

The present invention provides for an array of resistors to be manufactured using the above method. In a resistor chip array, multiple flip chip resistors are disposed on the same substrate.

The configuration of the present invention increases reliability of flip chip resistors, does not require expensive conductive materials for the electrode layers, and is especially advantageous in the case of small chip sizes as pad areas or electrode areas are large enough to promote reliable soldering.

DETAILED DESCRIPTION OF THE INVENTION

Figure 1:
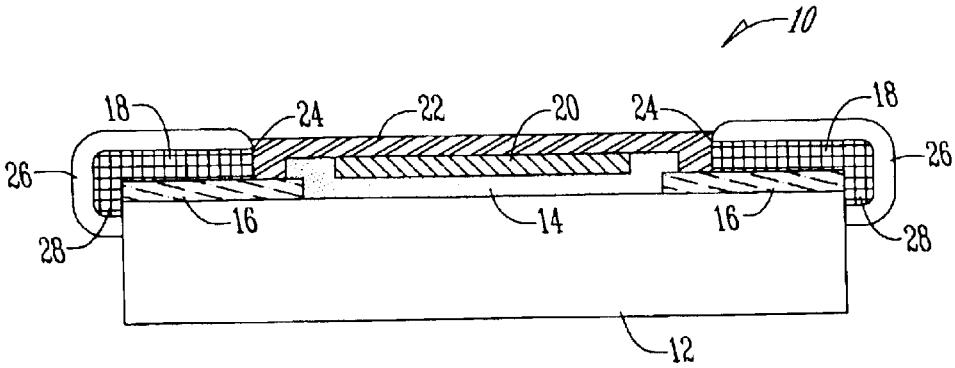
Fig. 1 (PRIOR ART)
FIG. 1 is a cross section of a prior art flip chip resistor.
Figure 2:
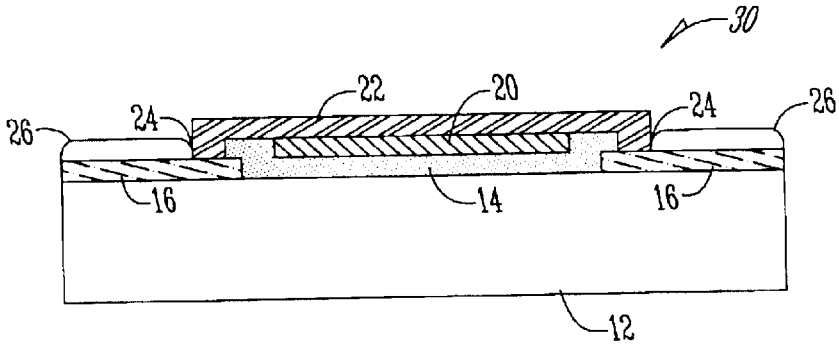
Fig. 2 (PRIOR ART)
FIG. 2 is a cross section view of another prior art flip chip resistor.

The present invention provides for a flip chip resistor. FIGS. 1 and 2 show prior art flip chip resistors illustrated for comparison purposes. The prior flip chip resistor 10 of FIG. 1 and the prior art flip chip resistor 30 of FIG. 2 both include a substrate 12 with a resistance layer 14 on the substrate 12. A first surface electrode layer 16 is shown. In addition, in FIG. 1, the prior art flip chip resistor 10 includes a second electrode layer 18. A first protection layer 20 and a second protection layer 22 are also shown. The electrode layers are covered by a plating 26. In both the prior art flip chip resistors, a junction 24 is shown. The junction 24 is a junction between the second protection layer 22 and the plating layer 26. It is this junction that is normally the weak point due to environmental conditions that result in reduced reliability. Further, with respect to the prior art flip chip resistor 30 of FIG. 2, the soldered area available is limited by the requirements of the resistance layer 14.

Figure 3:
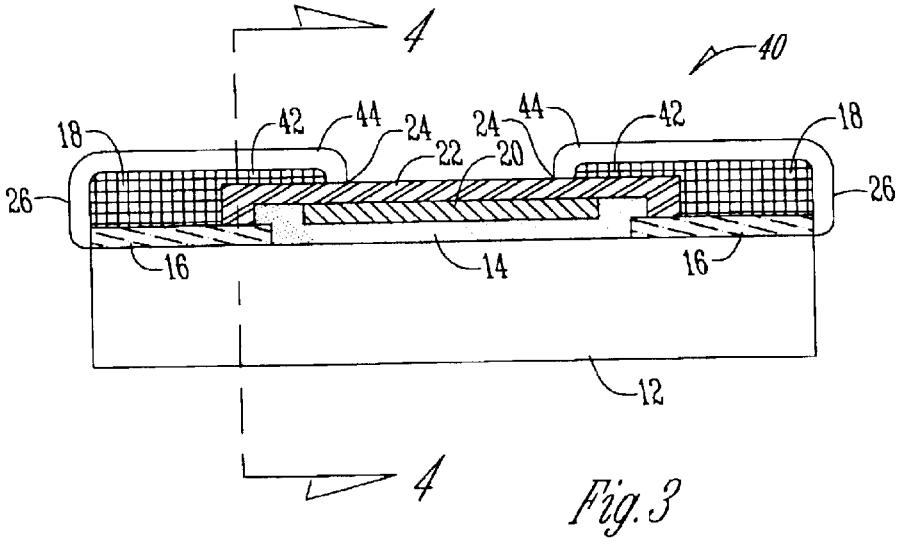
FIG. 3 is a cross section of a flip chip resistor according to one embodiment of the present invention.

FIG. 3 provides a section view of one embodiment of the present invention. In FIG. 3, the second electrode layers 18 are extended along the protection layer 22 so that the junction 24 between the plating 26 and the second protection layer 22 is not disposed over the first electrode layer 16. In FIG. 3, a flip chip resistor 40 is shown. The flip chip resistor 40 shown includes a substrate 12. The present invention contemplates numerous types of materials being used for the substrate 12. For example, the substrate 12 can be of various ceramic materials. Overlaying the substrate 12 is a resistance layer 14. The resistance layer 14 electrically contacts electrodes. Electrodes as shown are formed from a first surface electrode layer 16 and a second electrode layer 18. A first protection layer 20 overlays at least a portion of the resistance layer 14. A second protection layer 22 overlays the first protection layer 20. A plating 26 overlays each of the electrodes. As shown in FIG. 3, the junction 24 is disposed over a solid surface of the second protection layer 22. Thus the first electrode layer 16 is not exposed to environmental conditions resulting in increased reliability for the resistor. The second electrode layer 18 includes a portion 42 that extends at least partially over the second protection layer 22 and the resistance layer 14. Due to this configuration, the size of the soldered pads or plating area 26 is not restricted by the size of the resistance layer 14 such as occurs in the prior art of FIG. 2. As shown in FIG. 3, a portion of the plating 44 extends over a portion of protective layer 22 and a portion on the resistance layer 14 so that the plating area 26 can be increased in size.

Figure 4:
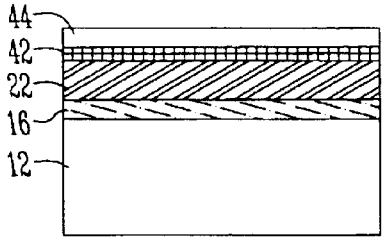
FIG. 4 is a section view taken along line 4—4 of FIG. 3 of a flip chip resistor according to one embodiment of the present invention.

FIG. 4 provides a section view taken along line 4—4 of FIG. 3. As shown in FIG. 4, a substrate 12 is shown with a first surface electrode layer 16 overlaying the substrate 12. A second protection layer 22 overlays the first electrode layer 16. A portion of the second electrode layer 42 overlays the second protection layer 22. A portion of plating 44 overlays the portion of the second electrode layer 42.

Figure 5:
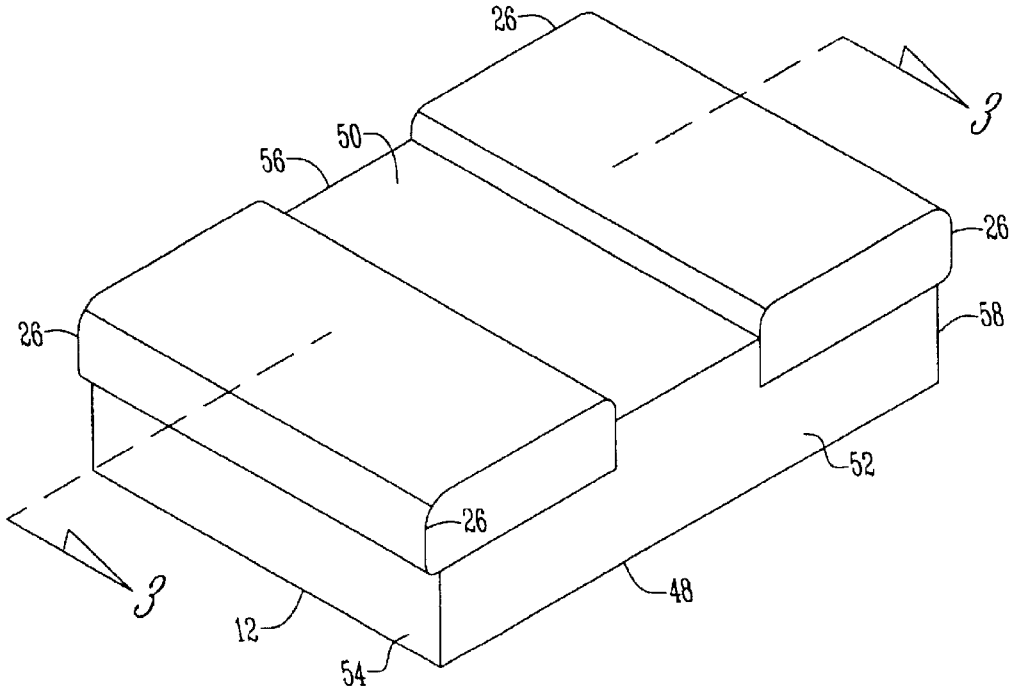
FIG. 5 is a perspective view of one embodiment of a flip chip resistor according to the present invention.

FIG. 5 provides a perspective view of one embodiment of a flip chip resistor according to the present invention. FIG. 3 is a section view taken along line 3—3 of FIG. 5. In FIG. 5, the flip chip resistor includes a bottom side 48, a top side 50, opposite sides 52, 56 and opposite ends 54, 58. The plated portions 26 of first and second electrodes are positioned opposite each other on the top surface 50 of the flip chip resistor. This allows the flip chip resistor to be solder mounted to a printed circuit board in a manner that reduces the amount of board space required. Further, the flip chip resistor of the present invention is particularly useful for small chip sizes because, as shown in FIG. 5, the solder pad or plating 26 areas are not limited by the size of the resistance layer and thus can be made sufficiently large to promote proper and reliable soldering of a flip chip resistor to a printed circuit board.

The present invention contemplates numerous variations in the materials and/or processes used. For example, the flip chip resistor of the present invention can be a thick film resistor or a thin film resistor. The substrate may be of various types, including being of various ceramic materials. The protective layer or layers of the present invention can be of various materials including, but not limited to resin materials. Similarly, the second conductive layers can be made of various materials, including but not limited to electroconductive polymers or electroconductive resin materials. The plating 26 can also be of various conductive materials, including but not limited to Nickel, Nickel alloys, and other metals and/or alloys. These and other variations are fully contemplated by the present invention.

The present invention also provides for a method of manufacturing a flip chip resistor. The present invention contemplates that such a method can be used to manufacture arrays of flip chip resistors. According to one embodiment of such a method, a first electrode layer is formed on a substrate to create a pair of opposite electrodes. A resistance layer is then applied between each layer of opposite electrodes, the resistance layer electrically connecting each pair of opposite electrodes. A first protective layer is applied at least partially covers the resistive layer. The resistance layer can be trimmed to an ordered value or otherwise desirable value by forming grooves in the resistance layer. A second protective layer is then applied that at least partially overlays a portion of the resistance layer. Then, a second electrode layer is applied that overlays the first electrode layer at least a portion of the second protective layer.

The substrate used can be a sheet-shaped substrate that is either prescored or unscored. Where a sheet-shaped substrate is used, the substrate can then be divided into individual flip chip resistors. Where an unscored sheet-shape substrate is used, the substrate can be divided into individual chips by dicing. Then, the second electrode layer of each flip chip resistor is plated.

Thus, in this manner, the present invention provides for a method of manufacturing a flip chip resistor. In particular, the method of manufacture of the flip chip resistor can be used to manufacture arrays of flip chip resistors. The present invention contemplates variations in the manner in which the various layers are applied, the types of materials, and other variations.

What is claimed is:

1. A flip chip resistor comprising:

a substrate having first and second end surfaces and a top surface, the top surface having first and second opposite end portions adjacent the first and second end surfaces respectively and having a central portion between the first and second end surfaces;

a first pair electrode layers disposed on and in contact with the first and second end portions respectively of the top surface of the substrate;

a resistance layer overlaying and in contact with the central portion of the top surface of the substrate and being electrically connected to the first pair of electrode layers;

a protective layer overlying the resistance layer;

a second pair of electrode layers overlying the first pair of electrode layers and extending over a portion of the adjacent protective layer;

a third pair of plating layers overlying the second pair of electrode layers and contacting the protective layer at a point above the resistance layer and not directly above the first pair of electrode layers.

2. The flip chip resistor of claim 1 wherein the protective layer comprises a first protective layer in contact with the resistance layer and a second protective layer overlying the first protective layer, the second pair of electrode layers extending over both of the first and second protective layers.

3. The flip chip resistor of claim 2 wherein the third pair of plating layers extend over both of the first and second protective layers.

4. A flip chip resistor comprising:

a substrate having first and second end surfaces and a top surface, the top surface having first and second opposite end portions adjacent the first and second end surfaces respectively and having a central portion between the first and second end surfaces;

a first pair electrode layers disposed on and in contact with the first and second end portions respectively of the top surface of the substrate;

a resistance layer overlaying and in contact with the central portion of the top surface of the substrate and being electrically connected to the first pair of electrode layers;

a protective layer overlying the resistance layer;

a second pair of electrode layers overlying the first pair of electrode layers and extending over a portion of the adjacent protective layer;

a third pair of plating layers overlying the second pair of electrode layers and contacting the protective layer, the third pair of plating layers also overlying the resistance layer and the protective layer.

5. A flip chip resistor comprising:

a substrate having first and second end surfaces and a top surface, the top surface having first and second opposite end portions adjacent the first and second end surfaces respectively and having a central portion between the first and second end surfaces;

a first pair electrode layers disposed on and in contact with the first and second end portions respectively of the top surface of the substrate;

a resistance layer overlaying and in contact with the central portion of the top surface of the substrate and being electrically connected to the first pair of electrode layers;

a protective layer completely overlying the resistance layer;

a second pair of electrode layers overlying the first pair of electrode layers and extending over a portion of the adjacent protective layer;

the second pair of electrode layers each having a portion that overlies both the protective layer and the resistance layer and the protective layer and is not directly above the first pair of electrode layers.

* * * * *